US005599006A

United States Patent [19]

Gevaux et al.

[11] Patent Number: 5,599,006

[45] Date of Patent: Feb. 4, 1997

[54] SELF STABLE FENCE

[75] Inventors: Bernard Gevaux, Prévières, 74250 Ville en Sallaz; Jacques Masurel, Ferney Voltaire, both of France

[73] Assignees: Constructions Metalliques de Bonneville, Bonneville; Bernard Gevaux, Ville en Sallaz, both of France

[21] Appl. No.: 507,350

[22] PCT Filed: Feb. 18, 1994

[86] PCT No.: PCT/FR94/00182

§ 371 Date: Aug. 17, 1995

§ 102(e) Date: Aug. 17, 1995

[87] PCT Pub. No.: WO94/19545

PCT Pub. Date: Sep. 1, 1994

[30] Foreign Application Priority Data

Feb. 26, 1993 [FR] France ..... 93 02401

[51] Int. Cl.[6] ..... E04H 17/18

[52] U.S. Cl. ..... 256/25; 256/1; 256/24; 256/31; 160/351

[58] Field of Search ..... 256/24, 25, 26, 256/27, 31, 19, 73, 35, 1, DIG. 6, 13.1, 59; 472/92, 94; 160/351

[56] References Cited

U.S. PATENT DOCUMENTS

| | | | |
|---|---|---|---|
| 2,581,318 | 1/1952 | Bartlett | 256/25 X |
| 4,909,483 | 3/1990 | van Herpen | 256/59 |
| 5,042,557 | 8/1991 | Norsworthy | 256/73 X |
| 5,188,342 | 3/1993 | Ouellette et al. | 256/65 |
| 5,213,312 | 5/1993 | MacDonald | 256/26 |
| 5,356,119 | 10/1994 | Schock | 256/31 X |

FOREIGN PATENT DOCUMENTS

| | | | |
|---|---|---|---|
| 2236373 | 1/1975 | France | 256/13.1 |
| 2706492 | 8/1978 | Germany | 256/24 |
| 3412354 | 10/1985 | Germany | 256/1 |
| 4000648 | 7/1991 | Germany | 256/24 |
| 470464 | 8/1937 | United Kingdom | 256/24 |
| 2228510 | 8/1990 | United Kingdom . | |

*Primary Examiner*—Harry C. Kim
*Attorney, Agent, or Firm*—William H. Eilberg

[57] ABSTRACT

A fence of the invention is made up of fence elements assembled together in sequence, each having a rigid first structure part (6) forming a vertical wall and a horizontal rigid second structure part (7) in a plane perpendicular to the base (8) of the first structure part (6). Concrete ballast elements (9) rest on the second structure part (7) to prevent tilting of the fence element and to render it self-stable. The top face (10) of the removable ballast elements (9) forms a generally flat surface on which users can move around.

10 Claims, 8 Drawing Sheets

SELF STABLE FENCE

TECHNICAL FIELD OF THE INVENTION

The present invention concerns a fence structure formed of fence elements adapted to be assembled on site to separate first and second parts of an area, for example an area for playing a game or sport and its surroundings.

The prior art includes fence structures with modular elements assembled together around multipurpose mini-stadia.

These fences are based on uprights embedded in the ground between which mesh wall panels are fixed.

These structures require embedding in the ground or even foundations in the ground. This rules out or makes difficult seasonal removal, modifications to change size or movement of the fence.

A guard rail structure for the roofs of buildings is described in document U.S. Pat. No. 5 188 342 in which the guard rail is stabilized by lower crossmembers each ballasted by a protruding block. A guard rail of this kind, designed for a specific application on the roofs of buildings, would obviously not be usable for fencing a playing area, as it would not allow easy and safe access to the public or to the players right up to the side of the fence carrying the crossmembers and the protruding blocks.

A crowd control barrier is described in document GB-A-2 228 510. The barrier is supported by a horizontal metal plate resting on the ground along the first side of the barrier and by a horizontal frame resting on the ground along the second side of the barrier, to which it is joined by oblique reinforcing struts. A structure of this kind does not allow easy and safe access of the public or of the players right up to the same side of the barrier as the horizontal frame and the oblique reinforcing struts.

SUMMARY OF THE INVENTION

The problem to which the present invention is addressed is that of designing a new fence structure that is easily movable, easily transportable and, to this end, adapted to be simply placed on the ground without requiring any embedding in or foundations in the ground, whilst having sufficient inherent stability to comply with safety requirements and in particular to withstand tilting forces applied to the fence by inclement weather or by users.

In accordance with the invention, the fence must be made stable without unnecessarily increasing the overall size of the fence itself, and in particular without reducing the usable size of the playing area on one side of the fence and without preventing free movement of users on the other side of the fence.

The basic idea of the invention stems from the observation that a fence for a playing area or other leisure activity area usually separates two parts of an area, a first part that has to be safely usable for sports activities right up to the vertical wall of the fence and a second part enabling movement of spectators and other users right up to the vertical wall of the fence. Thus the two parts of the area separated by the fence are used for different purposes.

In other circumstances, it is necessary to be able to use both parts of the area for movement of users right up to the vertical wall of the fence.

The invention builds on these observations to propose a new fence structure enabling players and users safe access right up to the vertical wall of the fence and having sufficient self-stability requiring no embedding in or foundations in the ground.

Accordingly, a fence element of the invention adapted to be assembled with other similar fence elements to form a fence between a first part and a second part of an area comprises:

- a rigid first structure part forming an upright (for example vertical) wall to separate the first part and the second part of the area,
- a rigid second structure part attached to the base of the rigid first structure part, said rigid second structure part lying in a plane at an angle to the rigid first structure part and being adapted to rest on the ground,
- at least one removable ballast element adapted to lay on the second structure part resting on the ground to prevent tilting of the fence element and to render it self-stable,
- the top face of the removable ballast elements of the successive fence elements forming a generally plane surface on which users can move around.

In a first embodiment, the second rigid structure part extends from one side of the base of the first structure part. This embodiment is suitable for fencing a playing area: the fence elements are then disposed so that the second rigid structure part resting on the ground faces away from the playing area, spectators being able to walk on the top surface of the removable ballast elements.

To provide a meeting area, on the other hand, the same fence elements are oriented so that the second rigid structure part resting on the ground faces towards the inside of the meeting area, the top face of the removable ballast elements constituting a rigid plane surface on which seats can be placed, the seat back being constituted by the vertical wall of the fence.

Another option is to provide a second rigid structure part extending away from both sides of the base of the first structure part.

In one embodiment of the fence element of the invention:

- the rigid second structure part comprises at least a rigid frame formed of a peripheral profiled member having a peripheral vertical flange and an interior bottom horizontal flange, the frame being attached externally to two crossmembers,
- the removable ballast element(s) rest on the horizontal flange of the frame and are flanked by the vertical flange of the frame,
- the crossmembers are attached to respective uprights between which panels are fixed.

The crossmembers preferably have a square cross-section the dimensions of which are such that their top faces are substantially flush with the top face of the removable ballast elements so as to constitute a pavement or walking area with a regular top surface.

The uprights are preferably round-section metal tubes plugged at the top and welded at the bottom to the top face of the respective crossmember. A round cross-section like this is beneficial from the safety point of view preventing injury to users who collide with the vertical wall of the fence.

BRIEF DESCRIPTION OF THE DRAWINGS

Other objects, features and advantages of the present invention will emerge from the following description of specific embodiments given with reference to the appended drawings, in which.

DESCRIPTION OF THE PREFERRED EMBODIMENTS

Figure 1:
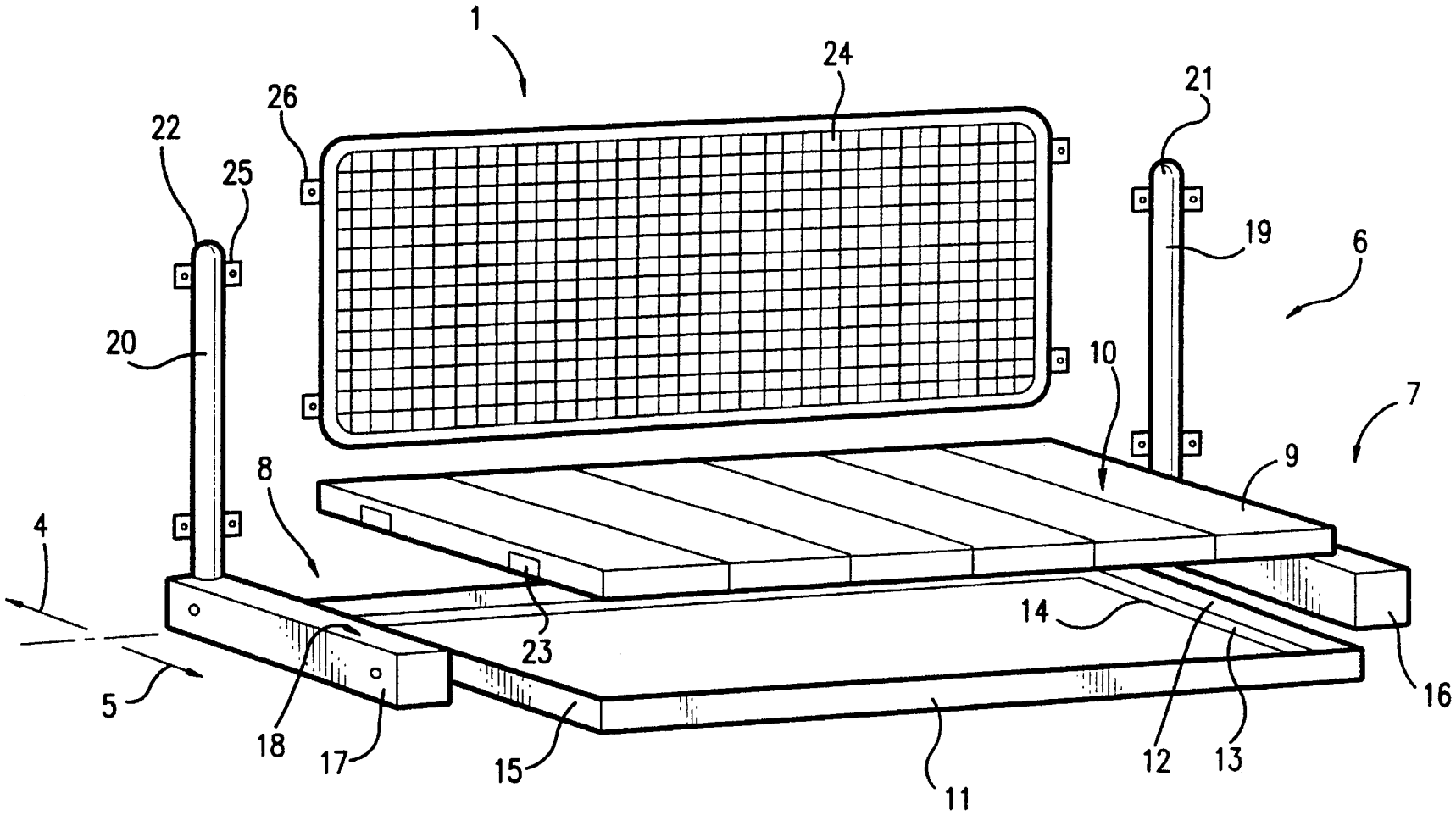
FIG. 1 is an exploded perspective view of a first embodiment of fence element of the invention.
Figure 2:
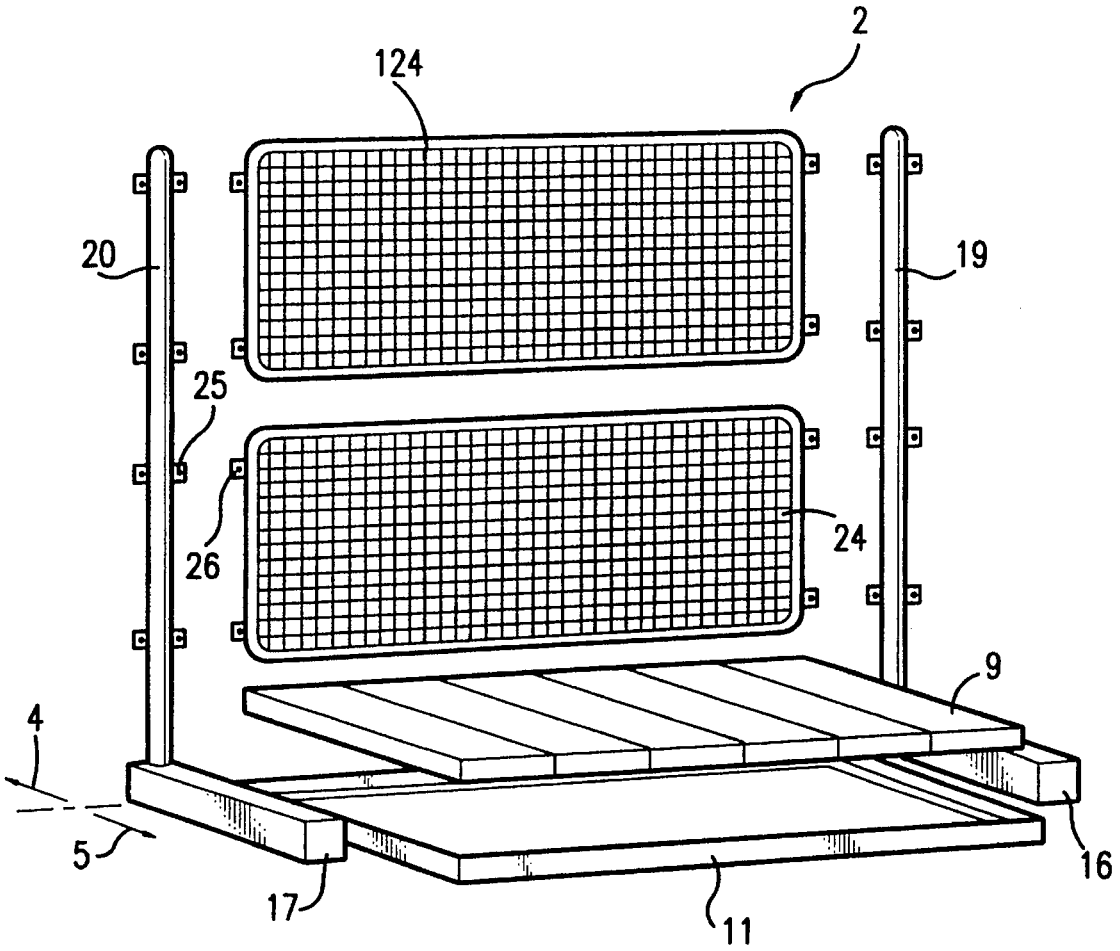
FIG. 2 is an exploded perspective view of a second embodiment of fence element of the invention.
Figure 3:
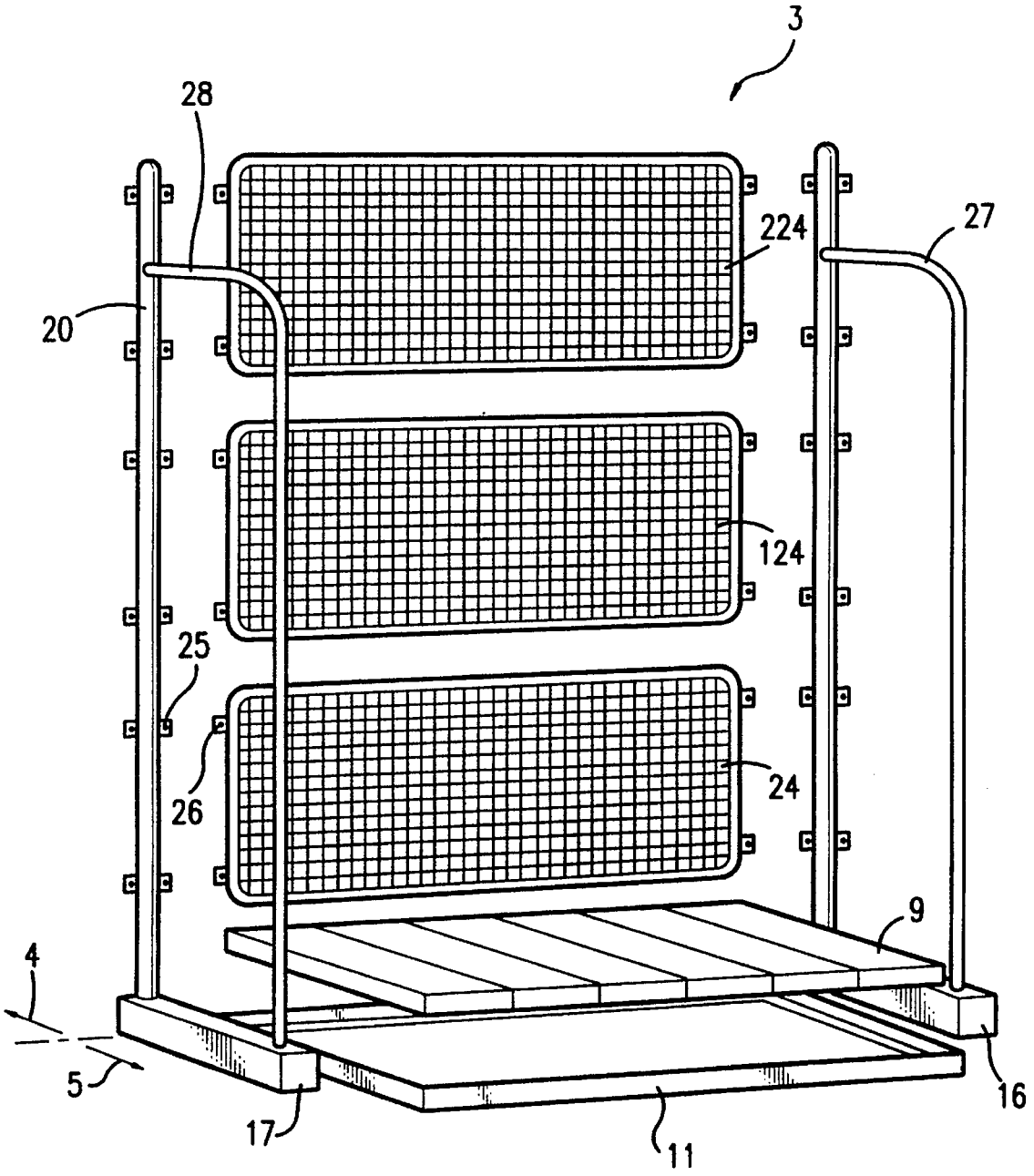
FIG. 3 is an exploded perspective view of a third embodiment of fence element of the invention.

In the embodiment of FIGS. 1 to 3, a fence element 1, 2 or 3 of the invention is adapted to form a fence between a first part of an area, shown by the arrow 4, and a second part of that area, shown by the arrow 5.

The fence element comprises a rigid first structure part 6 forming an upright (for example vertical) wall separating the first portion 4 of the area and the second portion 5 of the area.

The fence element includes a rigid second structure part 7 attached to and substantially perpendicular to one side of the base 8 of the first structure part 6. The rigid second structure part 7 is adapted to rest on the ground.

Removable ballast elements 9 are laid on the rigid second structure part 7 resting on the ground. The removable ballast elements 9 oppose tilting of the fence element 1–3 and so render it self-stable.

The top faces 10 of the removable ballast elements 9 of successive fence elements form a generally plane surface on which users can move around.

In the embodiments shown, the second structure part 7 includes a rigid frame 11 having a profiled member around the edge including a peripheral vertical flange 12 and a bottom horizontal flange 13 on the inside of the frame. The rigid frame 11 has a rectangular contour, for example, and its two transverse sides 14 and 15 are attached externally to respective crossmembers 16 and 17.

The removable ballast elements 9 engage within the frame 11, resting on the horizontal flange 13 of the frame 11 and flanked by the vertical flange 12 of the frame 11.

In the embodiment shown in FIGS. 1 through 3 a plurality of (for example six) removable ballast elements of generally flat parallelepiped shape are laid down side by side to fill in the space delimited by the peripheral frame 11. Each removable ballast element 9 advantageously has a weight less than the upper limit for manual handling, for example a weight less than 80 kilograms.

The removable ballast members 9 are made from cast reinforced concrete, for example, and can be prefabricated.

An alternative solution is to use a bottom shuttering plate to pour concrete directly into the frame 11. The resulting ballast element can subsequently be moved using a crane or other handling plant.

In all cases, the mass of the ballast elements 9 is chosen to prevent any tilting of the fence when subject to horizontal loading below a given loading value, corresponding to the thrust of two persons or to the weight of two persons attached to the rigid first structure part 6, for example.

The crossmembers 16 and 17 are preferably square in cross-section and have dimensions such that their top face (e.g. the top face 18 of the crossmember 17) are substantially flush with the top face 10 of the removable ballast elements 9 when the latter are laid in the rigid frame 11.

The crossmembers 16 and 17 are attached to respective uprights 19 and 20. The uprights 19 and 20 are round-section metal tubes plugged at the respective top end 21 and 22 and welded at the bottom end to the top face of the respective crossmember 16 or 17.

The rigid frame 11 is bolted to the respective crossmembers 16 and 17, for example, the bolts passing through respective holes shown in the figures. Appropriate voids 23 are provided in the removable ballast elements 9 for the bolts assembling the crossmembers to the rigid frame.

Panels such as the rectangular panel 24 are fixed between the successive uprights 19 and 20. The panels are preferably bolted together by means of holes provided in respective fixing lugs projecting laterally from the uprights and from the vertical edges of the panels. For example, respective fixing lugs 25 on the upright 20 and 26 on the lefthand vertical edge of the panel 24 are bolted together.

In the FIG. 1 embodiment, the height of the fence is relatively small. This embodiment is suitable for a height of about 120 cm. The fence element can then comprise a single rectangular panel 24 and the uprights 19 and 20 are simply welded to the respective crossmembers 16 and 17.

In the FIG. 2 embodiment the height of the fence is substantially twice the height of the FIG. 1 embodiment and the uprights 19 and 20 receive two panels 24 and 124, which are identical, for example.

The FIG. 3 embodiment is suitable for higher barriers, the total height being substantially three times the height of the FIG. 1 embodiment barrier. In this case the uprights 19 and 20 receive three panels 24, 124 and 224 disposed one above the other. To stiffen a structure of this kind the uprights 19 and 20 are associated with stiffener struts 27 and 28 joining an upper part of the respective upright 19 or 20 to the end part of the corresponding crossmember 16 or 17.

Figure 6:
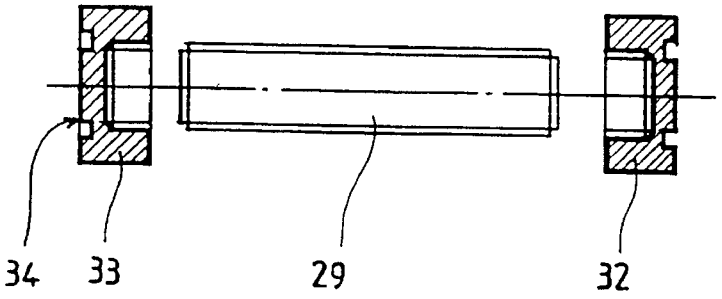
FIG. 6 is a view of the same assembly members shown in FIG. 5 in longitudinal section.
Figure 5:
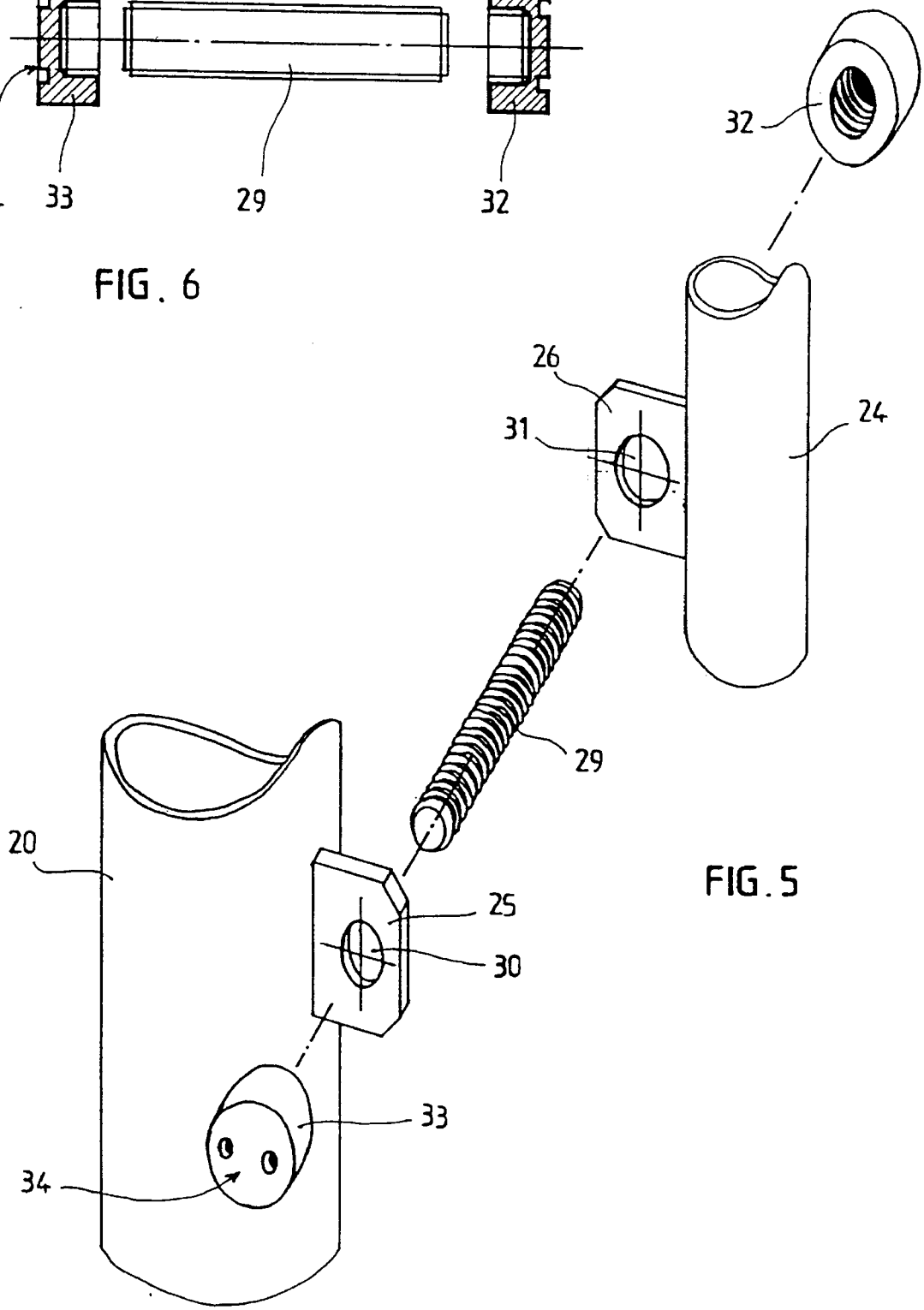
FIG. 5 is an exploded perspective view of members for assembling a panel to an upright of the invention.

As shown in FIGS. 5 and 6, the panels are preferably bolted on by means of studs 29 passing through respective holes 30 and 31 in the respective lugs 25 on the upright 20 and 26 on the vertical edge of the panel 24. Blind threaded caps 32 and 33 are screwed onto the ends of the studs 29. Their end wall 34 is adapted to be turned by means of a special tool to prevent unauthorized unscrewing using conventional tools. Two or more holes are formed in the end face 34, for example, in which engage corresponding pins on a special tool.

Figure 7:
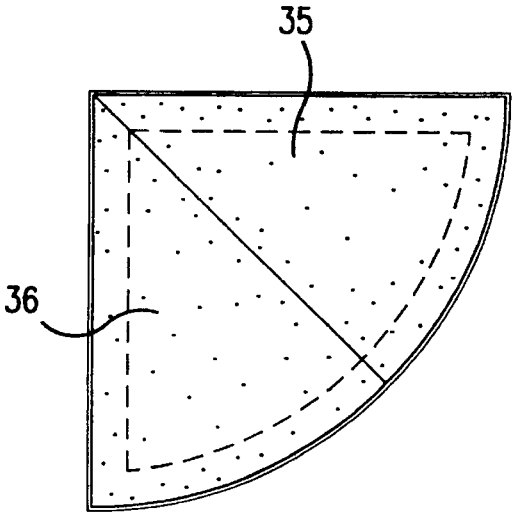
FIG. 7 is a top view of circular sector shape removable ballasting elements adapted to occupy a corner.

FIG. 7 is a top view of a special kind of removable ballast element. A quarter-circle sector is made up of two removable ballast elements 35 and 36.

Figure 4:
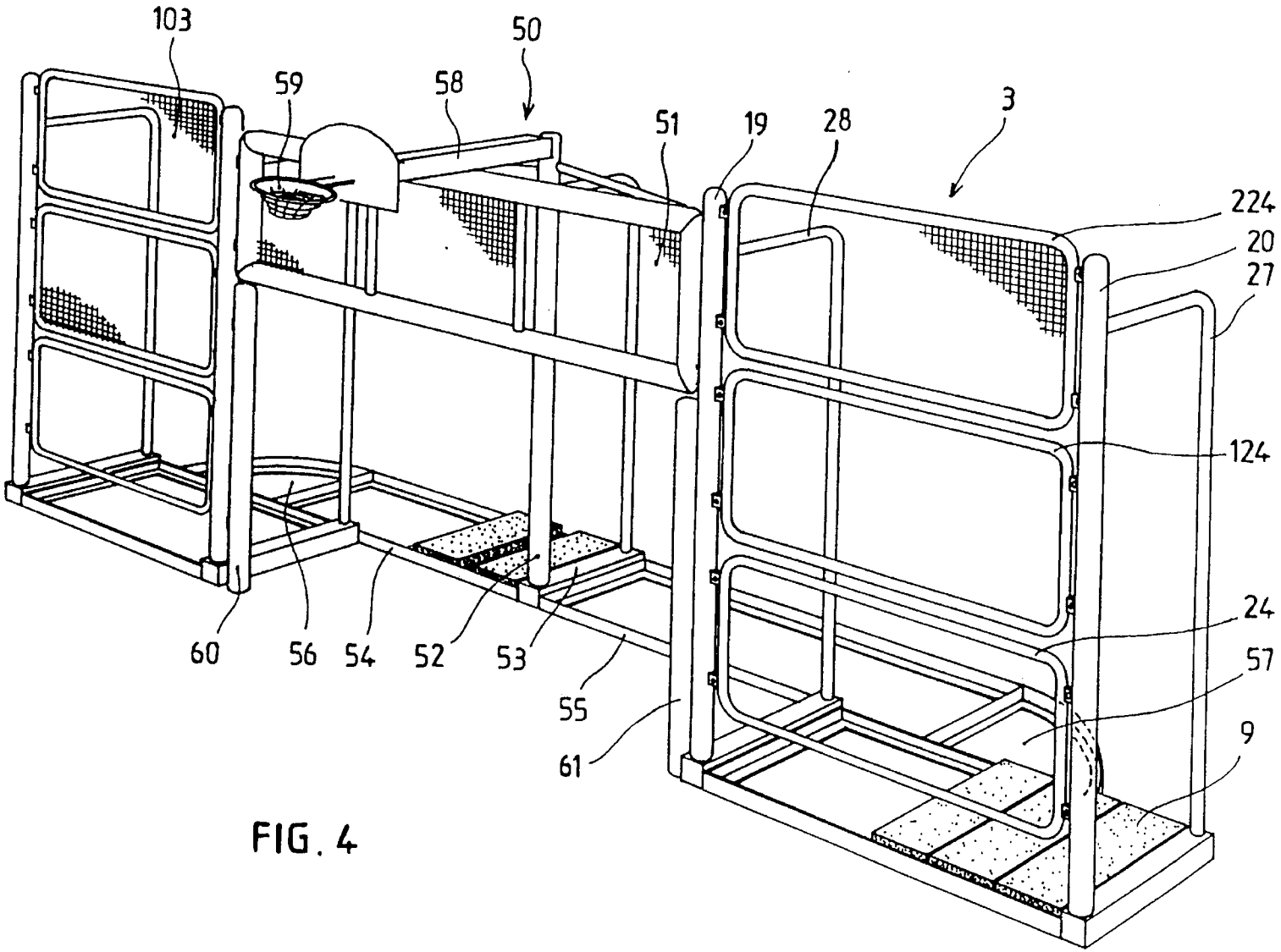
FIG. 4 is a perspective view of fence elements of the invention assembled to constitute a goal area for a playing area.

FIG. 4 is a perspective view showing fence elements of the invention assembled to form a fenced area near the goal area of a playing area.

The assembly comprises two end elements 3 and 103, each with three panels, of the type shown in FIG. 3 and flanking a central assembly 50. The central assembly 50 comprises a top panel 51 aligned with the top panels of the side elements 3 and 103 and a central upright 52 that is set back and associated with a crossmember 53 at the rear of the area occupied by the rigid second structure parts of the fence elements 3 and 103. The crossmember 53 is associated with two rigid frames 54 and 55 disposed on respective opposite sides of the crossmember 53 and partially flanking the rear sides of the rigid frames of the lateral elements 3 and 103. Quarter-circle sector shape connecting frames 56 and 57 extend the respective rigid rectangular frames 54 and 55, providing a wider surface in the lateral areas, for example for turning wheelchairs.

The central upright 52 carries a boom 58 at the end of which is a basketball net 59.

The top panel 51 is fixed to two adjacent uprights of the lateral elements 3 and 103. The space under the top panel 51 constitutes the goalmouth. In the goalmouth area, the two adjacent uprights of the lateral elements 3 and 103 are covered by respective round-section secondary uprights 61 and 60 with no attachment lugs on the visible surface. During installation, removable ballast elements are laid in all the rigid frames, only some of them being shown in the figure. The connecting frames receive circular sector shape elements 35 and 36 as shown in FIG. 7.

Figure 10:
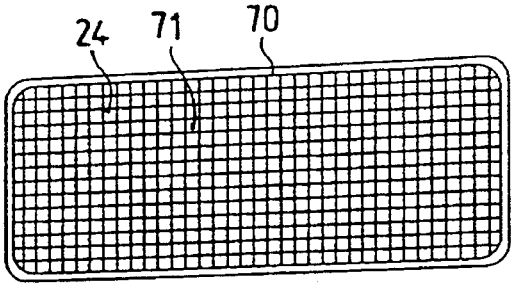
FIGS. 10 through 12 show three embodiments of panels for constituting vertical walls of a fence in accordance with the invention.

FIG. 10 shows an embodiment of the panel 24 comprising a circular-section steel tube peripheral frame 70 to which is welded a welded square mesh 71 made from approximately 5 mm diameter wire, for example. A panel of this kind can be 2.40 meters long by about 1 meter high.

Figure 11:
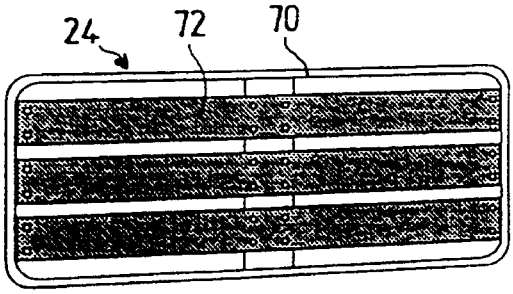

FIG. 11 shows a second embodiment of the panel 24 in which the welded mesh is replaced by wooden planks 72 attached to the metal frame 70.

Figure 12:
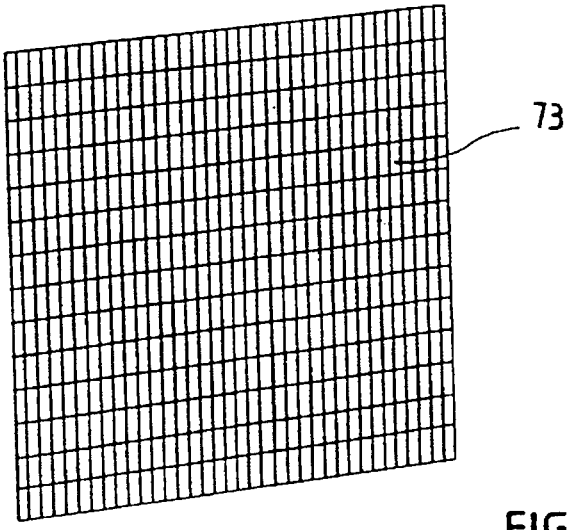

FIG. 12 shows another embodiment in which the frame is a welded mesh 73.

Figure 8:
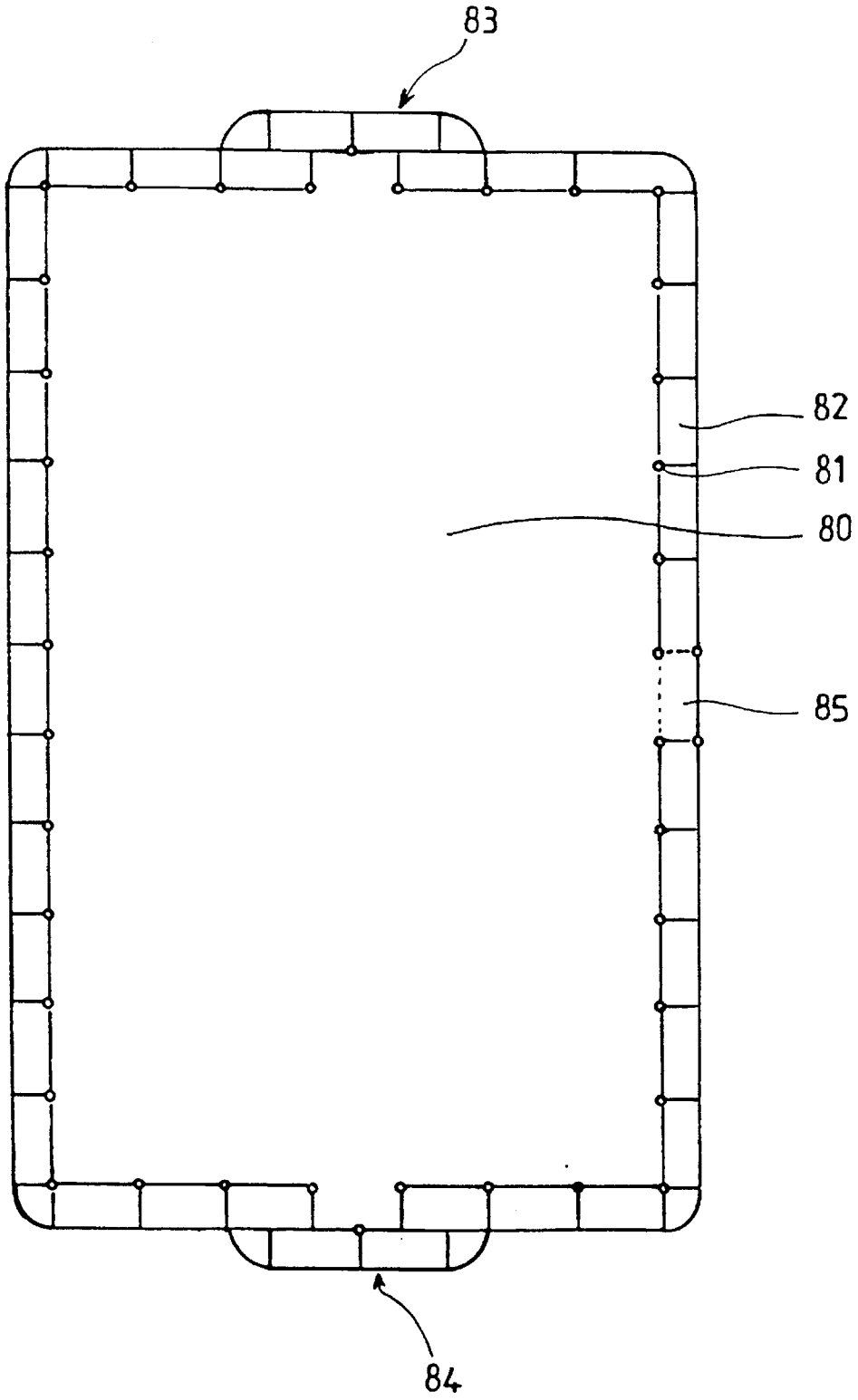
FIG. 8 is a diagrammatic top view showing the assembly of fence elements of the invention around a playing area.

FIG. 8 is a plan view of a playing area surrounded by a fence of the invention. The fence elements are disposed all around the playing area 80, the uprights 81 being adjacent to the playing area, the frames and the removable ballast elements 82 being outside the playing area. The ballast elements 82 constitute a flat external peripheral area around which users can move. The goal areas 83 and 84 are constructed as shown in FIG. 4, for example. An entry chicane 85 can advantageously be provided in the form of a fence element disposed with the opposite orientation to the adjacent elements, i.e. with the removable ballast elements and the rigid frames facing towards the sports ground, with the fence element offset outwards as shown in the figure.

Figure 9:
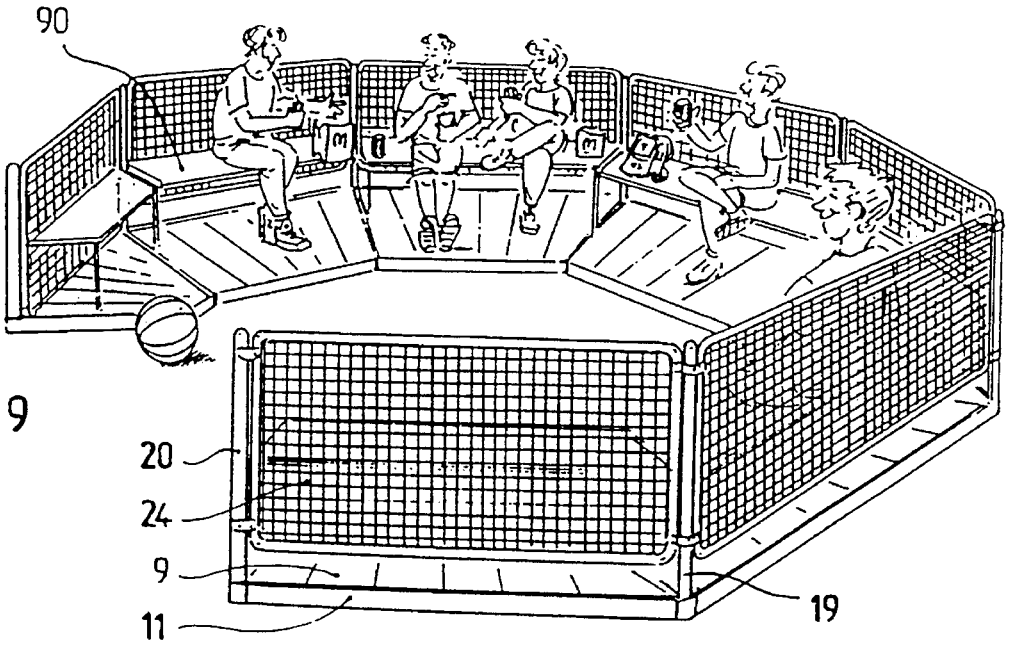
FIG. 9 is a perspective view of an assembly of fence elements of the invention constituting a meeting area.

FIG. 9 shows one mode of use of fence elements of the invention to construct a meeting area. A plurality of fence elements similar to that of the FIG. 1 embodiment are disposed one after the other to form an open circle. The ballast elements 9 are on the inside of the circle. Seats 90 can be attached to the ballast elements, the panels 24 constituting a back for the seats.

Figure 13:
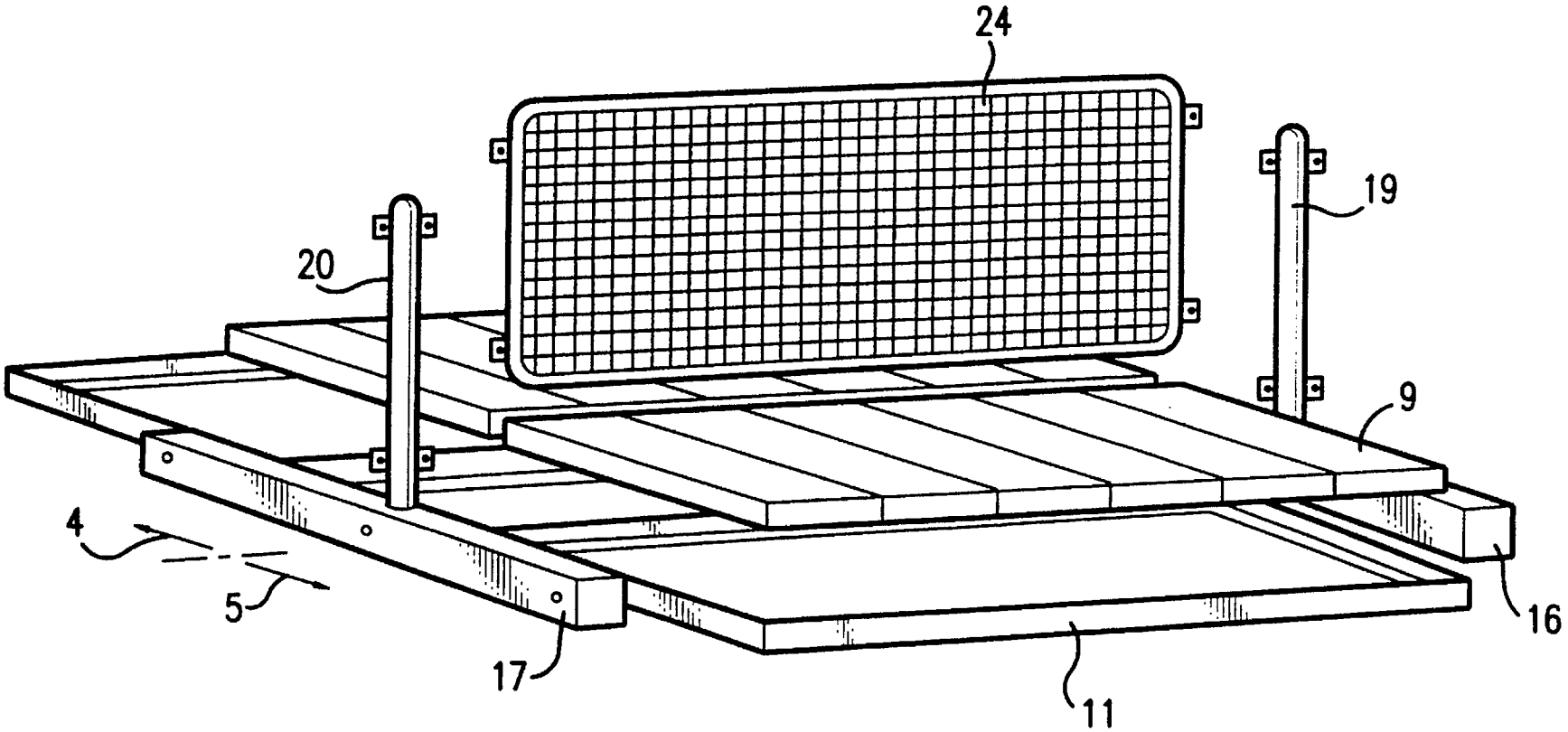
FIG. 13 shows another embodiment of fence element of the invention.

FIG. 13 shows an embodiment of the fence elements in which the rigid second structure part 7 comprises two rigid second structure part 7 areas on opposite sides of the base 8 of the rigid first structure part 6.

Each rigid second structure part 7 area has a structure similar to that of the rigid second structure part in the embodiments of FIGS. 1 to 3. It therefore comprises a frame 11, removable ballast elements 9 and crossmembers 16, 17 attached to uprights 19, 20.

The present invention is not limited to the embodiments described explicitly hereinabove but encompasses variations and generalizations thereof within the scope of the following claims. In particular, a fence element can be produced in which the rigid first structure part 6 is adapted to be inclined to the vertical at an appropriate angle: the angle between the two rigid structure parts is then an angle other than a right angle.

We claim:

1. Fence element adapted to be assembled with other similar fence elements in sequence to form a fence between a first part (4) and a second part (5) of an area, comprising:

a rigid first structure part (6) forming an upright wall to separate the first part (4) and the second part (5) of the area, a rigid second structure part (7) attached to the rigid first structure part (6), said rigid second structure part (7) lying in a plane at an angle to a base (8) of the rigid first structure part (6) and being adapted to rest on the ground, at least one removable ballast element (9) adapted to lie on the second structure part (7) resting on the ground to prevent tilting of the fence element and to render it self-stable, each said at least one removable ballast element (9) having a top face (10) forming a generally planar surface on which users can move around, wherein the rigid second structure part (7) extends from one side of the base (8) of the rigid first structure part (6), wherein the rigid second structure part (7) comprises a rigid frame (11) formed of a peripheral profiled member having a peripheral vertical flange (12) and an interior bottom horizontal flange (13) the frame (11) being attached externally to two crossmembers (16, 17), wherein each said at least one removable ballast element (9) rests on the horizontal flange (13) of the frame (11) and is flanked by the vertical flange (12) of the frame (11), and wherein the crossmembers (16, 17) are attached to respective rights (19, 20) between which panels (24) are fixed, wherein the up-rights and panels together comprise the rigid first structure part (6).

2. Fence element according to claim 1 wherein:

the crossmembers (16, 17) have a square cross-section the dimensions of which are such that their top face (18) is substantially flush with the top face (10) of said at least one removable ballast element (9), the uprights (19, 20) are round-section metal tubes plugged at their top end (21, 22), welded at their bottom end to the top face (18) of the respective crossmember (16, 17), and optionally associated with stiffener struts (27, 28) connecting an upper area of the upright to an end area of the corresponding crossmember (16, 17).

3. Fence element according to claim 1 wherein the frame (11) is bolted to the crossmembers (16, 17) with bolts, wherein appropriate voids (23) being provided in said at least one removable ballast element (9) for the bolts.

4. Fence element according to claim 1 wherein the panels (24) are bolted to the uprights (19, 20) by means of holes (30, 31) in respective lugs (25, 26) projecting laterally from the uprights (20) and from vertical edges of the panels (24).

5. Fence element according to claim 4 wherein the panels (24) are bolted on by means of studs (29) passing through the holes (30, 31) in the respective lugs (25, 26) and to which are screwed blind screwthreaded caps (32, 33), wherein an end wall (34) of each of said cups is conformed to be rotated by a special tool to prevent unauthorized unscrewing by means of conventional tools.

6. Fence element according to claim 1 wherein: the rigid frame (11) has a rectangular contour, and wherein each said at least one removable ballast element (9) has a generally flat parallelepiped shape and is laid to fill a space delimited by the rigid frame (11).

7. Fence element according to claim 6 wherein the weight of said each removable ballast element (9) is less than a permissible limit for manual handling.

8. Fence element according to claim 1 wherein said at least one removable ballast element (9) is made from cast reinforced concrete.

9. Playing or leisure area flanked by a fence made up of said fence elements according to claim 1.

10. Fence element adapted to be assembled with other similar fence elements in sequence to form a fence between a first part (4) and a second part ( 5 ) of an area, comprising:

a rigid first structure part (6) forming an upright wall to separate the first part (4) and the second part (5) of the area, a rigid second structure part (7) attached to the rigid first structure part (6), said rigid second structure part (7) lying in a plane at an angle to a base (8) of the rigid first structure part (6) and being adapted to rest on the ground, at least one removable ballast element (9) adapted to lie on the second structure part (7) resting on the ground to prevent tilting of the fence element and to render it self-stable, each said at least one removable ballast element (9) having a top face (10) forming a generally planar surface on which users can move around, wherein the rigid second structure part (7) comprises respective rigid second structure part (7) areas on opposite sides of the base (8) of the rigid first structure part (6), wherein each rigid second structure part (7) area comprises a rigid frame (11) formed of a peripheral profiled member having a peripheral vertical flange (12) and an interior bottom horizontal flange (13), the frame (11) being attached externally to two crossmembers (16, 17), wherein each said at least one removable ballast element (9) bears on the horizontal flange (13) of the frame (11) and is flanked by the vertical flange (12) of the frame (11), and wherein the crossmembers (16, 17) are attached to respective uprights (19, 20) between which panels (24) are fixed, wherein the uprights and panels together comprise the rigid first structure part (6).

* * * * *